US005662424A

United States Patent [19]

Shuhei et al.

[11] Patent Number: 5,662,424

[45] Date of Patent: Sep. 2, 1997

[54] MECHANICAL PENCIL

[75] Inventors: Kageyama Shuhei; Ebinuma Tadayoshi, both of Saitama-ken, Japan; Thomas Clem, Lincoln, R.I.

[73] Assignee: A.T. Cross Company, Lincoln, R.I.

[21] Appl. No.: 508,489

[22] Filed: Jul. 28, 1995

[30] Foreign Application Priority Data

Aug. 29, 1994 [JP] Japan ..... 6-203741

[51] Int. Cl.[6] ..... B43K 21/16; B43K 21/22

[52] U.S. Cl. ..... 401/65; 401/54

[58] Field of Search ..... 401/65, 54

[56] References Cited

U.S. PATENT DOCUMENTS

| | | | |
|---|---|---|---|
| 4,895,467 | 1/1990 | Kageyama et al. | 401/65 |
| 4,896,982 | 1/1990 | Kageyama et al. | 401/65 |

FOREIGN PATENT DOCUMENTS

| | | | |
|---|---|---|---|
| 6106892 | 4/1994 | Japan | 401/65 |
| 479937 | 2/1938 | United Kingdom | 401/65 |
| 1017390 | 1/1966 | United Kingdom | 401/65 |
| 2120175 | 11/1983 | United Kingdom | 401/65 |

*Primary Examiner*—Steven A. Bratlie
*Attorney, Agent, or Firm*—Colucci & Umans

[57] ABSTRACT

A mechanical pencil has a front sleeve, a cap rotatably and detachably mounted at the rear end of the front sleeve, and a lead advancing mechanism contained in the front sleeve. Rotation of the cap actuates the lead advancing mechanism to advance a lead. The mechanical pencil prevents breakage of lead and has low manufacturing costs. A rotation cam mechanism is disposed behind the lead advancing mechanism for advancing lead. The rotation cam mechanism has a rotation cam for rotating in accordance with rotation of a cap and a cam sleeve biased to engaged the rotation cam. An inside diameter of the front end of the cam sleeve is larger than an outside diameter of the rear end of the lead advancing mechanism so that the rear end of the lead advancing mechanism is inserted into the front end of the cam sleeve with a clearance in the radial direction. An inside diameter of the rear end of the lead advancing mechanism is larger than the outside diameter of a lead to establish a clearance there also. Due to these clearances, if the pencil is dropped, lead is not broken due to distortion of the lead advancing mechanism.

7 Claims, 3 Drawing Sheets

MECHANICAL PENCIL

FIELD AND BACKGROUND OF THE INVENTION

The present invention relates to a mechanical pencil having a front sleeve or barrel, a cap rotatably and detachably mounted at the rear end of the front sleeve, and a lead advancing mechanism contained in the front sleeve, rotation of the cap actuating the lead advancing mechanism to advance a lead.

Such a mechanical pencil is disclosed in Japanese patent publication No. 63-84381. That mechanical pencil comprises a cam engaging means integrally connected to the rear end of a lead chuck of a lead advancing mechanism contained in a front outer sleeve and a cam sleeve connected to a rear outer sleeve. The cam engaging means is biased to engage a front end of the cam sleeve. The cam engaging mean moves to and fro in an axial direction to advance a lead in accordance with rotation of the rear outer sleeve. However, in the prior mechanical pencil, if an external shock is applied to the mechanical pencil when, for example, the mechanical pencil is dropped, the lead advancing mechanism and a front end of the front outer sleeve displace differently and any lead supported by them is broken.

SUMMARY OF THE INVENTION

An object of this invention is to eliminate the drawbacks of the prior art and to provide a mechanical pencil which can prevent the breakage of lead and whose manufacturing costs can be reduced.

In order to accomplish the objects of the invention, a mechanical pencil according to the invention has a front sleeve, or barrel, a cap rotatably and detachably mounted to the rear end of the front sleeve, and a lead advancing mechanism contained in the front sleeve. Rotation of the cap actuates the lead advancing mechanism to advance a lead. Further in the mechanical pencil, a rotation cam mechanism is displaced behind the lead advancing mechanism for actuating the lead advancing operation. The rotation cam mechanism comprises a rotation cam for rotating with rotation of the cap and a cam sleeve biased to engage the rotation cam. An inside diameter of the front end of the cam sleeve is larger than an outside diameter of the rear end of the lead advancing mechanism so that the rear end of the lead advancing mechanism is inserted into the front end of the cam sleeve with a clearance in the radial direction. An inside diameter of the rear end of the lead advancing mechanism is larger than an outside diameter of a lead in the mechanism.

Preferably, the clearance between the inner surface of the rear end of the lead advancing mechanism and the lead is equal to or larger than a clearance between the inner surface of the front end of the cam sleeve and the outer surface of the rear end of the lead advancing mechanism.

Preferably, the front sleeve or barrel is made of a plastic other than poly-acetal resin. A ring is fixed to a front end of the cap and a spacer member made of poly-acetal resin is fixed to a rear inner end of the front sleeve or barrel. The rear end of the spacer member contacts this ring and a clearance is provided between the ring and the front sleeve. The cap can be made of plastic or metal.

Further, and preferably, cap inner ring is mounted in a rear inside of the cap, a female thread portion is formed on a rear end inner surface of the cap inner ring, an end plug is threadably inserted in the female thread portion of the cap inner ring, a slit extending in an axial direction is formed in the female thread portion of the cap inner ring, and rotation locking means for preventing relative rotation between the cap and the cap inner ring, are formed on an outer surface of the female thread portion.

In operation, the clearance between the rear portion of the lead advancing mechanism and the lead, and the clearance between the lead advancing mechanism and the rotation cam mechanism, constitute a double-clearance structure so that the lead is protected from distortion due to the lead advancing mechanism and from displacement of the cam sleeve when a shock is applied to the mechanical pencil, thus preventing breakage of or damage to the lead.

Especially when the clearance between the inner surface of the rear end of the lead advancing mechanism and the lead is equal to or is larger than the clearance between the inner surface of the front end of the cam sleeve and the outer surface of the rear end of the lead advancing mechanism, the lead is more positively prevented from damage or breakage.

Because the front sleeve or barrel and, in some cases, the cap are made of plastic, and the ring is fixed to the front end of the cap, manufacturing costs become lower without adversely affecting the appearance of the mechanical pencil. When the cap is rotated relative to the front sleeve, the ring slideably rotates against the spacer member which is made of poly-acetal resin, but never contacts other members that are made of a plastic, other than acetal resin. Because the spacer member made of poly-acetal resin has high abrasion-resistance and smoothness, even if the ring is made of either metal or plastic, or the cap is made of metal or plastic, the relative rotation between the ring or cap and the spacer member is smooth with good operation and without harming any members.

Because the mechanical pencil comprises the cap inner ring mounted in a rear inside of the cap, a female thread potion formed on a rear end inner surface of the cap inner ring and an end plug threadably inserted in the female thread portion of the cap inner ring, the appearance of the mechanical pencil is good. When the cap inner ring is molded, a core pin can be withdrawn forcibly from the female thread portion without spirally rotating along the thread because the slit formed in the female thread portion of the cap inner ring expands to release the core pin. This manufacturing step thus becomes simplified and the manufacturing costs become lower. The rotation locking means on the outer surface of the female thread portion prevents the slit from spreading in the cap and thus prevents the end plug from inadvertently falling out from the female thread portion.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiment of the invention is illustrated.

DESCRIPTION OF THE PREFERRED EMBODIMENTS

Figure 1:
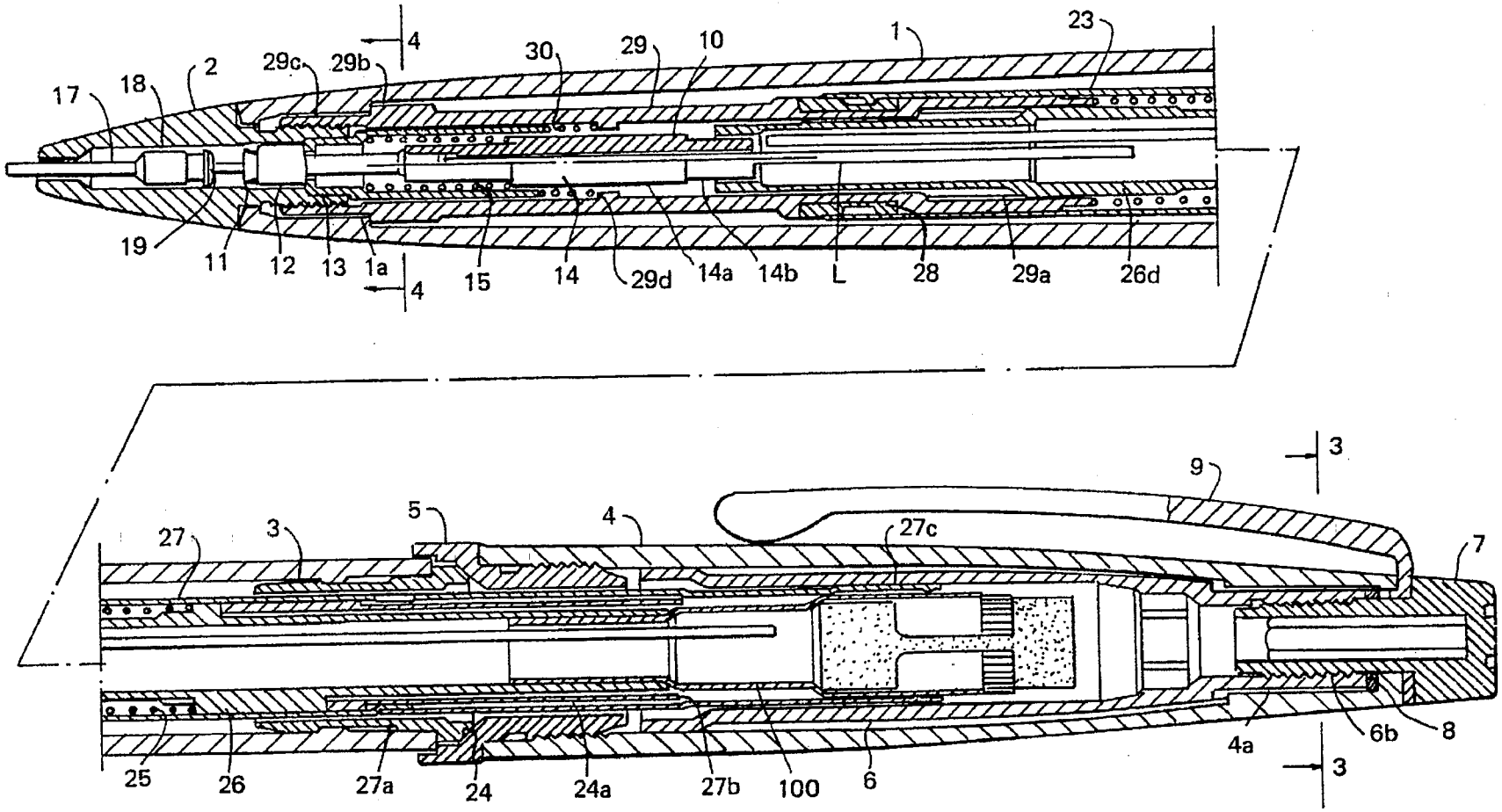
FIG. 1 is a front longitudinal cross-sectional view of an embodiment of the mechanical pencil according to the present invention, with half of the lead advancing mechanism being shown in elevation.

The following describes, in detail, an embodiment according to the present invention. FIG. 1 is a longitudinal cross-sectional view of an embodiment of the mechanical pencil according to the present invention.

Reference number 1 denotes a front sleeve or barrel made of metal or plastic, such as acrylic resin, AS, styrol, ABS resin, etc., having excellent brightness, and reference number 2 denotes a front tip provided at the front end of front sleeve 1. Spacer member 3 made of poly-acetal resin (POM which is sold under the brand name "DELRIN"or "DURACON") is fitted into and fixed to a rear inside of front sleeve or barrel 1.

Cap 4 can be made of metal or of plastic, such as acrylic resin, AS, styrol, ABS resin, etc., having excellent brightness. Cap 4 is mounted to the rear end of front sleeve 1. Ring 5 made of metal or plastic, is integrally fixed to the front end of cap 4 by thread bonding to make a good appearance, for the mechanical pencil. Ring 5 and cap 4 are rotatably and detachably mounted to front sleeve 1. There is a clearance between ring 5 and front sleeve 1, however, the rear end of spacer member 3 slidably and rotatably abuts against ring 5, for example, at mating inclined surfaces thereof.

Figure 2:
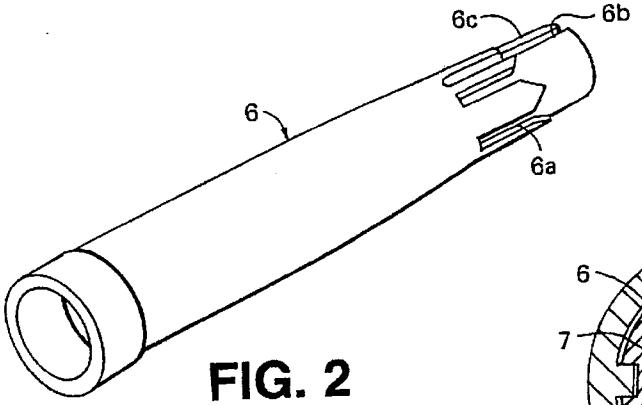
FIG. 2 is a perspective view of the cap inner ring of the embodiment of FIG. 1.
Figure 3:
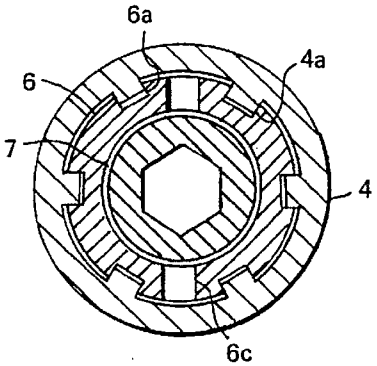
FIG. 3 is a lateral cross-sectional view taken at line 3—3 of FIG. 1.

Cap inner ring 6 is mounted in a rear inside of cap 4. Female thread portion **6*b* is formed on a rear inner surface of cap inner ring 6, as shown in FIG. 2. Slits 6*c* extending in an axial direction, are formed in female thread portion 6*b*. End plug 7 is threadably fixed to female thread portion 6*b* through a washer 8. Washer 8 may be omitted, however. A plurality of longitudinal recesses 6*a* to be engaged to longitudinal ribs 4*a* provided on a rear inner surface of cap 4, are formed on an outer surface of female thread portion 6*b* of cap inner ring 6 to prevent relative rotation between cap inner ring 6 and cap 4. Alteratively, longitudinal ribs may be formed on cap inner ring 6 and longitudinal recesses may be formed on cap 4. Clip 9 is fixed between cap 4 and end plug 7**.

Lead advancing mechanism 10 contained in front sleeve 1 comprises chuck 11, chuck ring 12 mounted outside of chuck 11, chuck ring sleeve 13 abutting against the rear end of chuck ring 12, chuck connection 14 connected to chuck 11, and chuck spring 15 between chuck connection 14 and chuck ring sleeve 13 for biasing chuck 11 to the rear. These parts are contained in front sleeve 1 with chuck ring sleeve 13 contacting the rear end of front tip 2. A middle portion of chuck connection 14 constitutes larger diameter portion **14*a* and a rear portion of chuck connection 14 constitutes smaller diameter portion 14*b***.

Lead pipe 17 extends from front tip 2 together with lead L, and conical packing 19 connected to lead pipe 17 through slider 18 for supporting lead L, are contained in front tip 2.

Rotation cam mechanism 23 is disposed behind lead advancing mechanism 10. Rotation cam mechanism 23 comprises rotation cam 24 to be rotated with rotation of cap 4, cam sleeve 26 biased to engage rotation cam 24 by return spring 25, mounted sleeve 27 containing rotation cam 24 and cam sleeve 26, and sleeve receiver 29 fixing the front end of mounted sleeve 27 via securing ring 28.

Inner projections **27*a* are formed at the middle inner surface of mounted sleeve 27 and squeezed portion 27*b* is formed in a rear portion of mounted sleeve 27. Inner projections 27*a* fit longitudinal recesses 24*a* formed in a rear portion of rotation cam 24 and prevent relative rotation between mounted sleeve 27 and rotation cam 24 while squeezed portion 27*b* regulates the rear position of rotation cam 24 and determines the axial position of rotation cam 24. Outer projection 27*c* are also formed in a further rear portion of mounted sleeve 27 to prevent relative rotation between mounted sleeve 27 and cap 4**.

Figure 4:
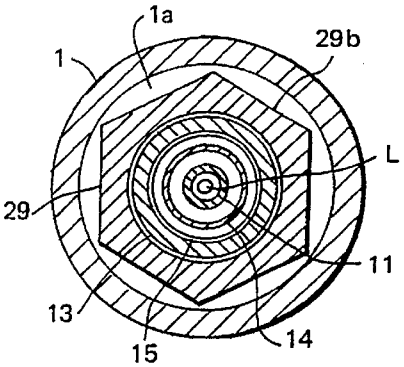
FIG. 4 is a lateral cross-sectional view taken at line 4—4 of FIG. 1.

Longitudinal recesses **29*a* are formed on a rear inner surface of sleeve receiver 29 and polygonal expansion 29*b* is formed on a front outer surface of sleeve receiver 29. Longitudinal ribs 26*d* formed on an outer surface of cam sleeve 26 engage longitudinal recess 29*a* and prevent relative rotation between cam sleeve 26 and sleeve receiver 29. Polygonal expansion 29*b* fits into polygonal bore 1*a* of front sleeve 1 and prevents relative rotation between sleeve receiver 29 and front sleeve 1 (see FIG. 4). Female thread portion 29*c* is formed on a front inner surface of sleeve receiver 29 for thread-bonding engagement with front tip 2**.

Figure 5:
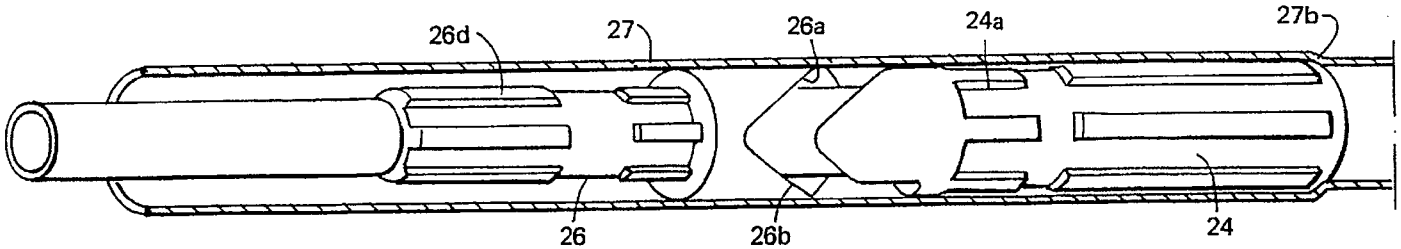
FIG. 5 is a perspective view illustrating a rotation cam and cam sleeve of the embodiment of FIG. 1.
Figure 6:
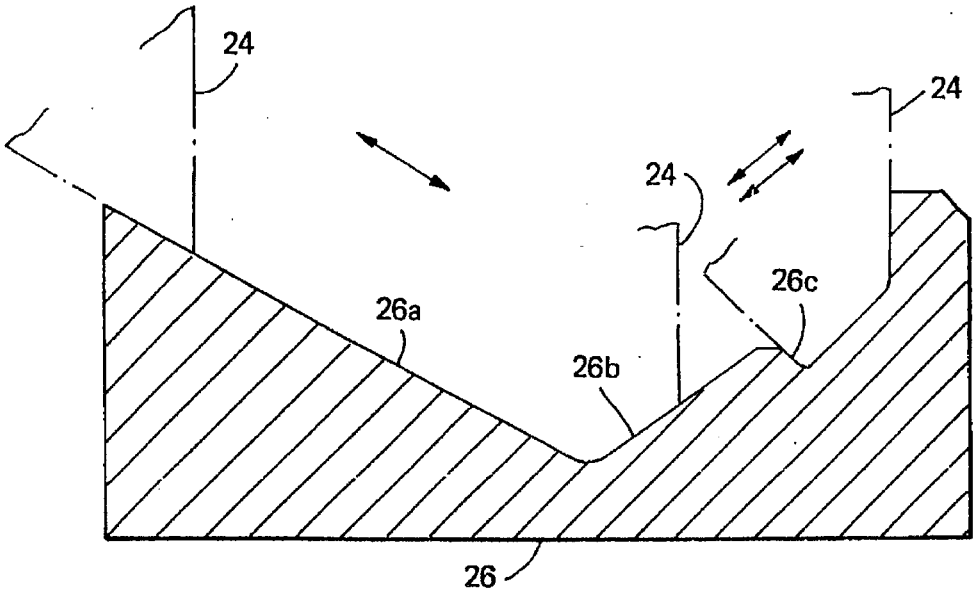
FIG. 6 is a developmental view of the cam surface of the cam sleeve.

FIG. 5 is a perspective view illustrating rotation cam 24 and cam sleeve 26 of the embodiment. FIG. 6 shows a developed view of a cam surface of cam sleeve 26. The cam surface of cam sleeve 26 has large cam surface **26*a* for sliding to incremetally advance lead L and small cam surface 26*b* for sliding to release chuck 11 with rotation of rotation cam 24, and trapping portion 26*c* for keeping chuck 11 of lead advancing mechanism 10** in a lead releasing position.

Lead advancing mechanism 10 and rotation cam mechanism 23 are assembled in the following manner. Lead advancing mechanism 10 is dropped in to the front sleeve 1 from the rear of front sleeve 1. Cushion spring 30 and rotation cam mechanism 23 are then dropped into front sleeve 1 from the rear of front sleeve 1 so as to engage polygonal expansion **29*b* of sleeve received 29 with polygonal bore 1*a* of front sleeve 1, and female thread portion 29*c* of sleeve receiver 29 is connected to front tip 2 by thread-bonding. Cushion spring 30 is interposed between internal expansion 29*d* of sleeve receiver 29 and chuck ring sleeve 13**.

Figure 7:
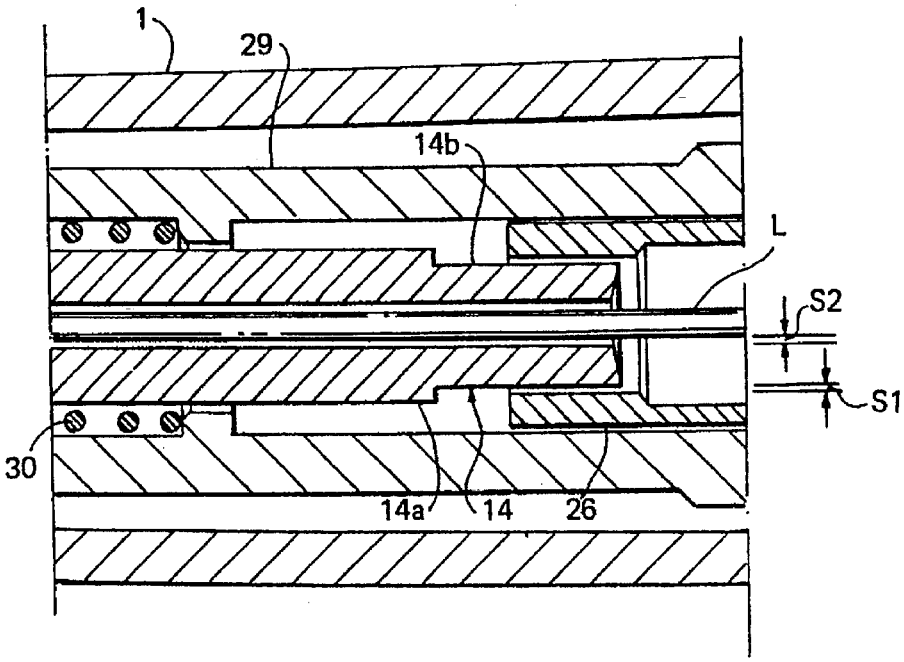
FIG. 7 is an enlarged longitudinal cross-sectional view of the rear portion of the lead advancing mechanism and the front end portion of the rotation cam mechanism of FIG. 1.

Smaller portion **14*b* of chuck connection 14 of lead advancing mechanism 10 is inserted into the front end of cam sleeve 26 with a clearance in the radial direction. Namely, as shown in FIG. 7, an inside diameter of the front end of cam sleeve 26 is larger than an outside diameter of smaller portion 14*b* of chuck connection 14, and an inside diameter of smaller portion 14*b* of chuck connection 14 is larger than an outside diameter of lead L. As explained, a clearance between lead L and lead advancing mechanism 10 at the rear portion of lead advancing mechanism, 10 and a clearance between lead advancing mechanism 10 and rotation cam mechanism 23, constitute a double-clearance structure so that the lead is protected from distortion of the chuck connection 14 and displacement of the cam sleeve 26** when a shock is applied to the mechanical pencil, thus preventing damage or breakage of lead L.

The clearance in the radial direction between cam sleeve 26 and smaller portion **14*b* of chuck connection 14 is denoted S1. The clearance in the radial direction between lead L and chuck connection 14 is denoted S2. If they are set so as to satisfy S2≧S1, shock resistance will increase. It is assumed that when a shock is applied to the mechanical pencil, chuck connection 14 abuts against cam sleeve 26 rather than against lead L, and a displacement of chuck connection 14** from the central axis, due to the shock, is restricted.

When the mechanical pencil according to the embodiment is used, cap 4 is rotated relative to front sleeve 1. Ring 5 rotates with cap 4 and slides and rotates relative to spacer member 3. At this time, ring 5 never contacts or rotates relative to any plastic members except POM spacer member 3. Spacer member 3, made of acetal resin is abrasion-resistant and lubricating, ring 5 made of metal or plastic rotates smoothly with good operation without harming any parts.

Rotation of cap 4 is transmitted to mounted sleeve 27 and rotating rotation cam 24. If rotation cam 24 rotates toward large cam surface 26*a*, the rotation of rotation cam 24 is transmitted into an axial movement and cam sleeve 26 advances in an axial direction so that its front end pushes larger diameter portion 14*a* of chuck connection 14 and lead advancing mechanism 10 advances a lead. When cap 4 becomes free, cam sleeve 26 is returned to the rear direction by the force of return spring 25 and rotation cam 24 returns to the initial position.

If rotation cam 24 rotates in a reverse direction, it slides toward small cam surface 26*b* of cam sleeve 26 and is trapped in trapping portion 26*c*. Cam sleeve 26 advances in the axial direction and stops so that its front end is kept from pushing larger diameter portion 14*a* of chuck connection 14 and chuck 10 of lead advancing mechanism 10 is kept in a lead releasing state. Therefore, lead L and lead pipe 17 can be pushed into front tip 2 at this time, and they are thus retracted into front tip 2.

In the mechanical pencil of this embodiment, end plug 7 is threadably mounted to female thread portion 6*b* formed on the inner surface of cap inner ring 6 mounted to the rear inside of cap 4, and the appearance is good. When cap inner ring 6 is molded, a core pin can be withdrawn forcibly from female thread portion 6*b* without spirally rotating along the thread because slits 6*c* expand to release the core pin. Therefore, this manufacturing step becomes simplified and manufacturing costs become lower.

In addition, end plug 7 is firmly fixed because longitudinal recess 6*a* at outer surface of female thread portion 6*a* engages longitudinal rib 4*a* of cap 4, slit 6*c* can not spread in cap 4.

One effect of the present invention which is inherent from its structure is that an eraser adapter shown at 100 in FIG. 1, which is connected to the rear end of cam sleeve 26, can be directly pressed axially, when cap 4 is removed, to advance lead. Further, to allow use of the eraser without advancing lead, the strength of spring 15 and, to a lesser extent, the strength of spring 25, are selected to be stronger than the usual pressing force needed to erase.

As explained above, in the present invention, because the clearance between the rear portion of the lead advancing mechanism and the lead and the clearance between the lead advancing mechanism and the rotation cam mechanism constitute a double-clearance structure, the lead is protected from distortion of the lead advancing mechanism and a displacement of the cam sleeve when a shock is applied to the mechanical pencil, thus preventing the lead from breakage or damage.

When the clearance between the inner surface of the rear end of the lead advancing mechanism and the lead is equal to or is larger than a clearance between the inner surface of the front end of said cam sleeve and the outer surface of the rear end of the lead advancing mechanism, the lead is prevented from damage or breakage to an even greater extent.

Because the front sleeve and the cap can be made of plastic and the ring is fixed to the front end of the cap, manufacturing costs can be reduced without the appearance of the mechanical pencil being harmed. Because the ring slideably rotates against the spacer member made of poly-acetal resin but never contacts members made of plastic (except acetal resin), the relative rotation between the ring and the spacer member is smooth with good operation without harming any members.

Because an end plug is threadably inserted in the female thread portion of the cap inner ring, the appearance of the mechanical pencil is good. When the cap inner right is molded, a core pin can be withdrawn forcibly from the female thread portion without spirally rotating along the thread because the slit formed in the female thread portion of the cap inner ring expands to release the core pin. Therefore this manufacturing step becomes simplified and the manufacturing costs becomes lower. The rotation locking means on the outer surface of the female thread portion prevents the slit from spreading in the cap and thus prevents the end plug from inadvertently falling out from the female thread portion.

While a specific embodiment of the invention has been shown and described in detail to illustrate the application of the principles of the invention, it will be understood that the invention may be embodied otherwise without departing from such principles.

What is claimed is:

1. A mechanical pencil comprising:

a front sleeve (1);

a cap (4) rotatably and detachably mounted to a rear end of the front sleeve;

a lead advancing mechanism (10) contained in the front sleeve and structured so that rotation of the cap actuates the lead advancing mechanism to advance a lead (L);

a rotation cam mechanism (23) disposed behind the lead advancing mechanism (10) for actuating a lead advancing operation, said rotation cam mechanism comprising a rotation cam (24) for rotating in accordance with rotation of said cap (4), and a cam sleeve (26) biased (25) to engage said rotation cam (24);

an inside diameter of a front end of said cam sleeve being larger than an outside diameter of a rear end (14*b*) of said lead advancing mechanism, said rear end of said lead advancing mechanism positioned at all times in said front end of said cam sleeve with a first clearance (S1) in a radial direction; and an inside diameter of said rear end (14*b*) of said lead advancing mechanism being larger than an outside diameter of a lead (L) by a second clearance (S2).

2. The mechanical pencil according to claim 1, wherein the second clearance (S2) between the inner surface of the rear end of said lead advancing mechanism and the lead is equal to or is larger than the first clearance (S1) between the inner surface of the front end of said cam sleeve and the outer surface of the rear end of said lead advancing mechanism.

3. The mechanical pencil according to claim 1, wherein said front sleeve and said cap are made of plastic other than poly-acetal resin, a ring (5) fixed to a front end of said cap, a spacer member (3) made of poly-acetal resin fixed to a rear inner end of said front sleeve, the rear end of said spacer member contacting said ring, and a clearance being between said ring and said front sleeve.

4. The mechanical pencil according to claim 1 including a cap inner ring (6) mounted in a rear inside of said cap, a female thread portion (6*b*) formed on a rear end inner surface of said cap inner ring (6), an end plug (7) threadably inserted in said female thread portion, a slit (6*c*) extending in an axial direction formed in said female threaded portion (6*b*) of the cap inner ring (6), and rotation locking means (4*a*, 6*a*) for preventing relative rotation between the cap and the cap inner ring, defined on an outer surface of said female thread portion (6*b*).

5. The mechanical pencil according to claim 1, wherein said front sleeve is made at least partly of metal.

6. The mechanical pencil according to claim 1, including an eraser adapter connected to a rear end of said cam sleeve (26), said eraser adapter being adapted to receive an eraser and being pushable in an axial direction for advancing lead in said lead advancing mechanism.

7. A mechanical pencil according to claim 6, including a spring between said lead advancing mechanism and said front sleeve for biasing said lead advancing mechanism away from a lead advancing direction of movement with respect to said front sleeve, said spring being selected to have a biasing force which is greater than a force needed to erase using an eraser in said eraser adapter, to avoid advancing of lead when erasing with an eraser in the eraser adapter.

* * * * *